US005359161A

United States Patent [19]

Leach et al.

[11] Patent Number: 5,359,161

[45] Date of Patent: Oct. 25, 1994

[54] NON-LINEAR SPRING FOR CIRCUIT INTERRUPTERS

[75] Inventors: Thomas C. Leach, Lexington, Ky.; Steven A. DeCook, Marion, Iowa

[73] Assignee: Square D Company, Palatine, Ill.

[21] Appl. No.: 2,009

[22] Filed: Jan. 8, 1993

[51] Int. Cl.[5] ..... H01H 33/02; H01H 1/50

[52] U.S. Cl. ..... 200/746 R; 200/250; 267/158

[58] Field of Search ..... 200/146 R, 146 A, 146 AA, 200/239-251; 267/158-165

[56] References Cited

U.S. PATENT DOCUMENTS 4,849,589 7/1989 Dickens et al. ..... 200/146 R 5,210,385 5/1993 Morel et al. ..... 200/146 R

*Primary Examiner*—J. R. Scott

*Attorney, Agent, or Firm*—Larry I. Golden; Kareem M. Irfan

[57] ABSTRACT

The invention provides a spring exerting a non-linear force between a contact carrier and a contact blade in a circuit interrupter. The inventive spring includes at least one elongated cantilever. The length of the cantilever has the shape of an arch made with a non-uniform angle and is formed from an elastic material. The cantilever is supported at one end against the carrier with the length of the cantilever positioned parallel to the carrier and the opposite end of the cantilever abutting the contact blade so that the carrier supports more of the length of the cantilever as the displacement between the carrier and the contact blade decreases.

The invention also includes a method of operating a circuit interrupter by non-uniformly increasing the force exerted against a movable contact as it engages a stationary contact to complete a circuit.

16 Claims, 3 Drawing Sheets

NON-LINEAR SPRING FOR CIRCUIT INTERRUPTERS

FIELD OF THE INVENTION

The present invention relates to a spring exerting a non-linear force as it is deflected against an electrical contact during the opening and closing of the contacts within circuit interrupters and the like.

BACKGROUND OF THE INVENTION

Electric circuit breakers are commonly used to protect branch circuits in residential, commercial and industrial buildings against overload and fault conditions. Basically, a circuit breaker comprises a pair of separable contacts, an operating mechanism for effecting separation of the contacts, and a tripping mechanism which automatically releases the operating mechanism upon the occurrence of an overload or fault condition.

Circuit breaker and other circuit interrupters are often constructed with contacts and blades to form the electrical disconnect. Usually a torsion or compression spring is used to provide a linear force as the displacement between the contacts is changed. When the circuit breaker is operated, closing the contacts requires energy to overcome the deflection of the contacts. Opening the contacts requires energy to break the arc generated by breaking the electrical current flowing through the contacts.

The prior art as exemplified in U.S. Pat. No. 4,713,504 issued to Maier discloses a circuit breaker utilizing main and arcing contacts which open and close in pre-determined sequence. Force is applied to the contacts by the compression and release of springs attached to the contacts. As the breaker is operated from an open to a closed position, a period of time passes from the contacts first touching until the breaker latches. During this time period, the operating mechanism must provide energy to overcome the deflection of the spring on the contact blade. The energy drained from the spring slows the operation of the breaker.

The need arises to apply force to a plurality of contact blades in an efficient manner to overcome the problems associated with opening or closing sequence between main or arcing contacts or both.

SUMMARY OF THE INVENTION

Accordingly, the present invention provides a spring exerting a non-linear force between a contact carrier and a contact blade in a circuit interrupter. The inventive spring includes at least one elongated cantilever. The length of the cantilever has the shape of an arch made with a non-uniform angle and is formed from an elastic material. The cantilever is supported at one end against the carrier with the length of the cantilever positioned parallel to the carrier and the opposite end of the cantilever abuts the contact blade so that the carrier supports an increasing amount of the length of the cantilever as the displacement between the carrier and the contact blade decreases.

The present invention also contemplates a circuit interrupter including at least one stationary electrical contact located therein and at least one movable contact operable between open and closed positions with respect to each stationary contact. Each movable contact is attached to a contact blade. The circuit interrupter includes a contact carrier hingedly attached to the contact blade and means for effecting movement of the carrier and the contact blade so that the movable contact moves between the open and closed positions. The circuit includes further includes a spring of the description provided above.

The invention also includes a method of operating a circuit interrupter having at least one stationary contact and at least one movable contact attached to a contact blade and moved into open and closed positions by a contact carrier. The method includes the steps of exerting a predetermined force against the contact blade attached to the movable contact, engaging the movable contact against the stationary contact, and increasing the force exerted against the contact blade.

It is an object of the present invention to provide an inventive spring which overcomes the aforementioned problems affecting the opening and closing of circuit breakers particularly carrying large current loads.

Another object of the invention is to provide an inventive spring which exerts a non-linear force against the electrical contacts of a circuit breaker optimizing the applied force as the circuit is established through the contacts to avoid deflection therebetween.

A further object of the present invention is to provide individual support to multiple contacts utilizing a one-piece inventive spring eliminating the need for a large number of springs and other supporting parts, simplifying the manufacture of the circuit breaker and decreasing its accompanying cost.

Other and further advantages, embodiments, variations and the like will be apparent to those skilled in the art from the present specification taken with the accompanying drawings and appended claims.

BRIEF DESCRIPTION OF THE DRAWINGS

In the drawings, which comprise a portion of this disclosure:

FIG. 2A illustrates the circuit breaker and the electrical contacts in the open position, FIG. 2B illustrates the circuit breaker closing with the arc contacts closing, FIG. 2C illustrates the circuit breaker continuing to close with the arc contacts in the closed position and the main contacts starting to close, and FIG. 2D illustrating the circuit breaker and main contacts in the fully closed position with the arc contacts re-opened;

DETAILED DESCRIPTION

Figure 1:
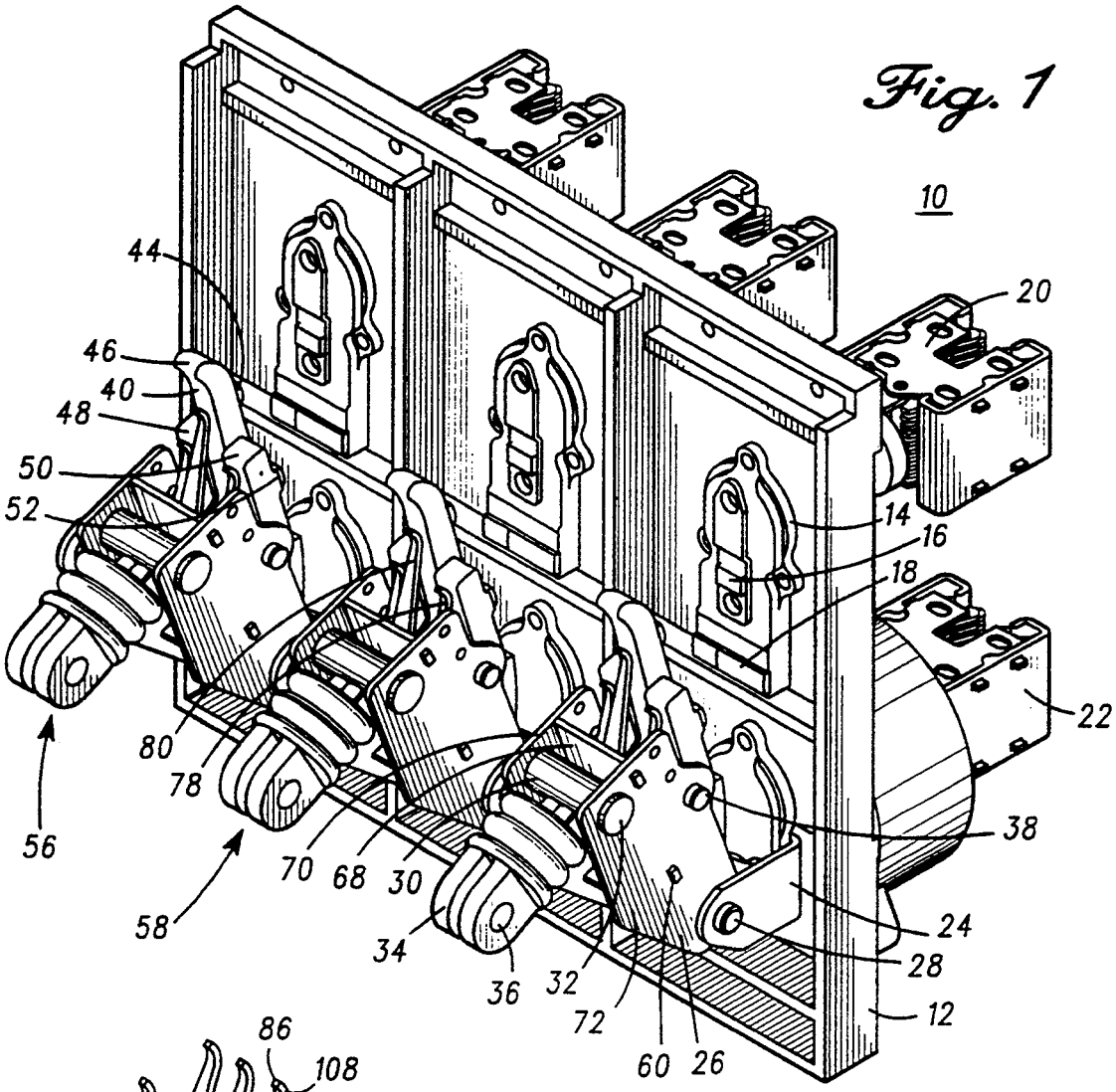
FIG. 1 is a perspective view of an embodiment of the present invention illustrated in a current path assembly of a circuit breaker.

Referring now to FIGS. 1 and 2, therein is shown a current path assembly 10 of a circuit breaker. The assembly 10 includes a base 12 having a plurality of stationary contacts formed on a mounting base 14 such as an arcing contact 16 and main contacts 18. A primary disconnect 20 for an incoming power line (not shown) extends through the base 12 to electrically connect with the stationary contacts 16, 18. Another disconnect 22 electrically connecting to a load (not shown) similarly extends through the base 12 to electrically connect with a stationary base 24.

A movable contact carrier assembly 26 is hingedly connected to the stationary base 24 with a pivot pin 28. A T-shaped connecting rod 30 hingedly connects to the carrier 26 at pivot pin 32. The opposite end 34 of the connecting rod connects to an operating mechanism (not shown). A shaft extending through the holes 36 of each connecting rod 30 simultaneously controls the movement of each carrier 26 mounted on the current assembly 10. The movement of the carrier 26 is controlled by an operating mechanism which responds to manual operation to open and close the electrical contacts or automatic response to an overload condition.

The carrier 26 supports the attachment of a plurality of contact blades at pivot pin 38. A long contact blade 40 attaches to a movable main contact 42 near the blade end proximal to the pivot pin 38. A movable arcing contact 44 attaches to the distal end 46 of the long contact blade 40. Two short contact arms 48, 50 each have a main movable contact like 52 attached near their respective distal ends.

The main movable contacts 42, 52 are capable of being in open and closed positions with respect to the main stationary contacts 18. Similarly, the arcing movable contact 44 is capable of being in an open and closed position with respect to the arcing stationary contact 16. As used herein, the term "open" as used with respect to the contact positions means that all the moveable contacts 42, 44 are spaced apart from all the stationary contacts 16, 18. Whereas, the term "closed" indicates the position wherein the movable contacts 42 are contacting both the stationary contacts 18 and the stationary base 24.

One end of a flexible conductor 54 is wielded to the contact blades 40, 48, and 50 to provide an electrical connection therebetween. The opposite end of the flexible conductor 54 is likewise suitably connected to the stationary base 14. The electrical circuit is completed from the arcing contact 44 and the main contacts 42 through the contact blade like 40, through the flexible conductor 54 to the stationary base 14 and the disconnect 22. In a similar manner, the circuits for different phases like 56 and 58 are completed.

The carrier 26 is defined by a spring plate 68 which extends perpendicularly between side walls 70, 72. The spring plate 68 is formed with tabs 60 which secure to corresponding holes formed in the side walls 70, 72 for connection therebetween. The spring plate 68 extends in a parallel direction over a substantial portion of the short contact blades 48, 50 and over most of the long contact blade 40. The pivot pins 28, 32, and 38 extend through respective holes 62, 64, and 66 to make a mechanical connection with the side walls 70, 72. Pivot pin 28 also extends through the stationary base 24 to maintain a mechanical connection with the carrier 26.

Figure 3:
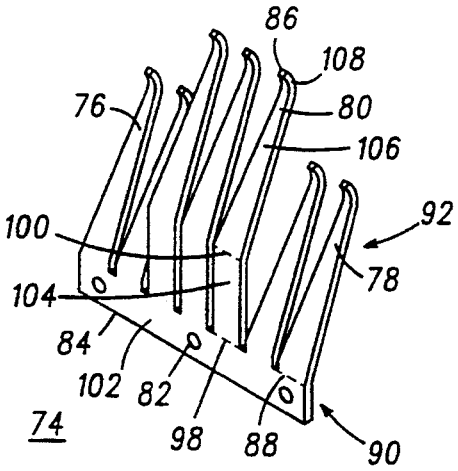
FIG. 3 is an isolated perspective view of a spring according to the present invention.

A spring 74 is disposed between the spring plate 68 and contact blades 40, 48, and 50. The spring 74 exerts a non-linear force between the spring plate 68 and the contact blade 40, 48 and 50. An embodiment of the spring 74 is more particularly illustrated in FIG. 3. The spring 74 includes at least one elongated cantilever such as the two sets of short cantilevers 76 and 78, and the set of long cantilevers 80. The term cantilever is defined by a projecting beam or member supported only at one end.

One end of the cantilever 80 is connected to the spring plate 68 for support. Fasteners (not shown) such as screws or rivets are inserted through holes 82 in one end 84 of the spring to engage the spring plate 68. Another suitable fastening means is, but not limited to, spot wielding. The connection of the spring 74 to the spring plate 68 is made to position the opposite end 86 of the cantilever 80 to abut the contact blade 40. The length of the cantilever 80 is also positioned parallel to the spring plate 68 of the carrier so that the spring plate 68 abuts and supports an increasing amount of the length of the cantilever 80 as the displacement or distance between the spring plate 68 and the contact blade 40 decreases.

The length of each cantilever like 78 has the shape of an arch made with a non-uniform angle across the length of the cantilever 78. The arch illustrated in FIG. 3 includes at least one angular bend 88, indicated by the broken line, positioned between generally straight segments 90 and 92 across the length of the short cantilever 78. The long cantilever 80 has two angular bends 98, 100 positioned along the length. The segment 102 between the spring end 84 and the first angular bend 98, the segment 104 between the first and second angular bends 98 and 100, and the segment 106 between the opposite spring end 86 and the second angular bend 100 have a relatively straight shape. Each angular bend like 100 is positioned at a pre-determined point along the length of the cantilever 80 to exert an greater force between the spring plate 68 and the contact blade 40 than the other segments of the cantilever's length like 104 when the spring plate 68 supports the angular bend 100. Once the angular bend 100 is supported by the spring plate 68 the effective length of the cantilever 80 is shortened with a consequential increase in force exerted thereby.

The present invention contemplates one or more angular bends formed along the length of the cantilever. The spacing of the angular bends determines the time during the operating cycle of the breaker in which the force exerted on the contact blade is increased and by how much.

The opposite end 86 of the cantilever includes a curl 108 extending in the direction opposite the angle of the arch to provide a smooth surface for abutting the topside 110 of the contact blade 40. When the distance between the contact blade 40 and the carrier 26 changes, the curl 108 slides along the topside 110 of the contact blade in adjustment.

Figure 2A:
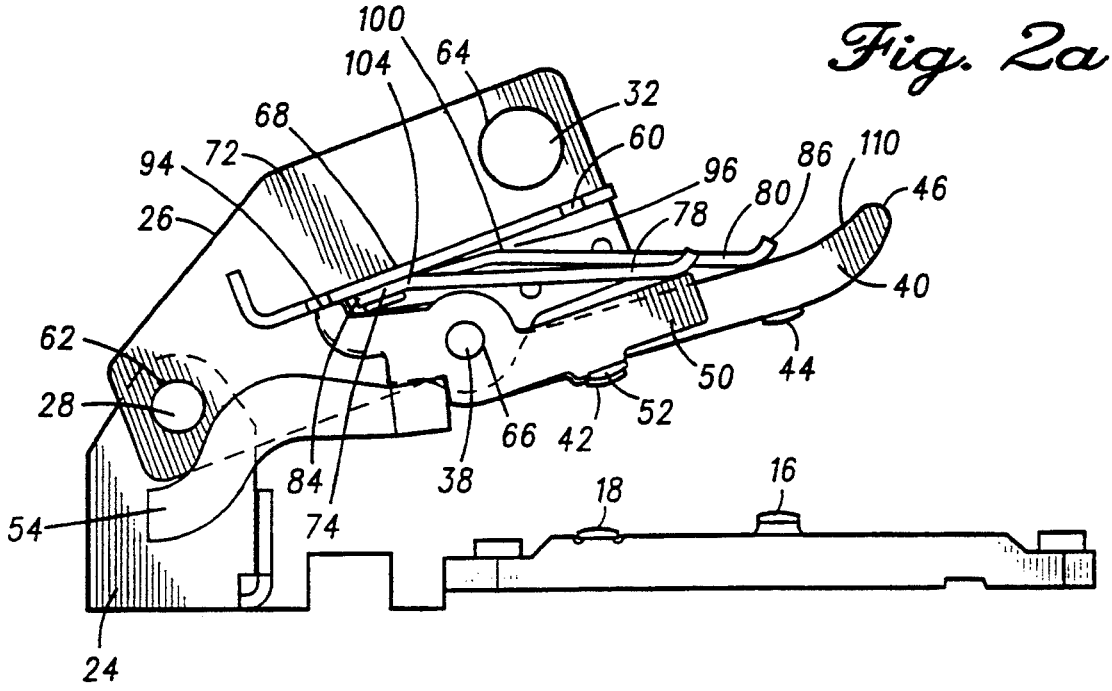
FIGS. 2A–2D are views of the contact carrier with the inventive spring utilized between the spring plate and contact blade during the operative states of the electrical contacts in a circuit breaker.

Referring now to FIGS. 2A through 2D, the operation of the spring 74 during the closing of the main contacts 18 and 42 is illustrated. FIG. 2A presents the carrier 26 and movable contacts 42, 44 in the open position. The spring 74 is pre-loaded with a small force exerted on the distal end 46 of the contact blade by having the proximal end 94 abutting the spring plate 68. The straight segment 104 between the first and second angular bends 98, 100 of the long cantilever 80 is spaced apart at point 96 from the spring plate 68.

Figure 2B:
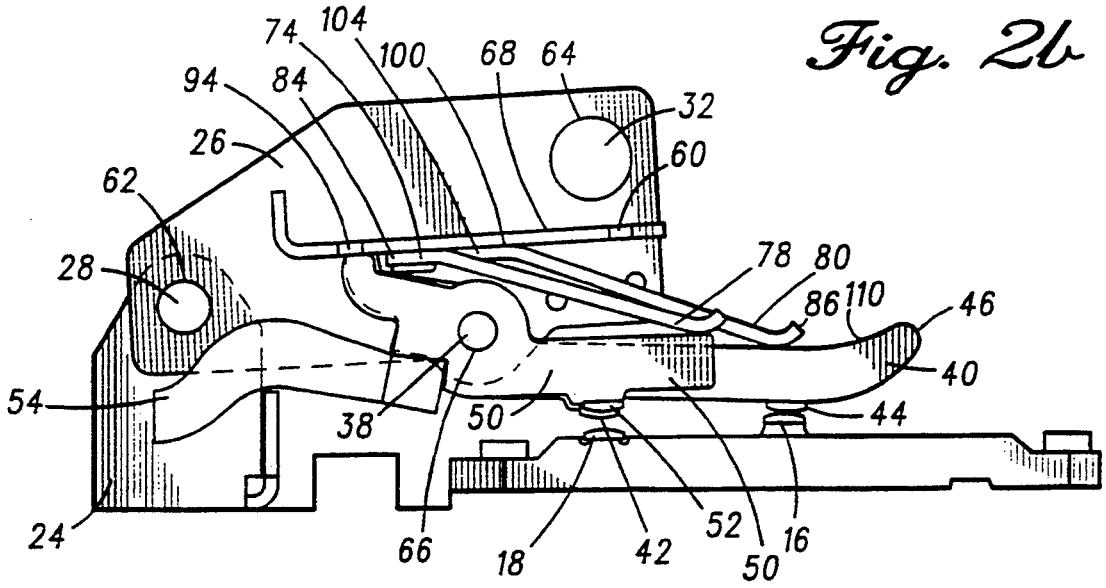

In FIG. 2B the current assembly 10 is beginning to close as the movable arcing contacts 44 engage the stationary arcing contacts 16. The main contacts 42 and 18 have not begun to engage. The long cantilever 80 is exerting a first level of force upon the contact blade 40 by having the straight segment 104 abutting the spring plate 68 and consequently forcing the two arcing contacts 44 and 16 together. To resist the force generated from completing the circuit which may be tending to separate the arcing contacts 44 and 16, the second angular bend 100 is supported by the spring plate 68 and increases the force exerted on the contact blade 40.

Figure 2C:
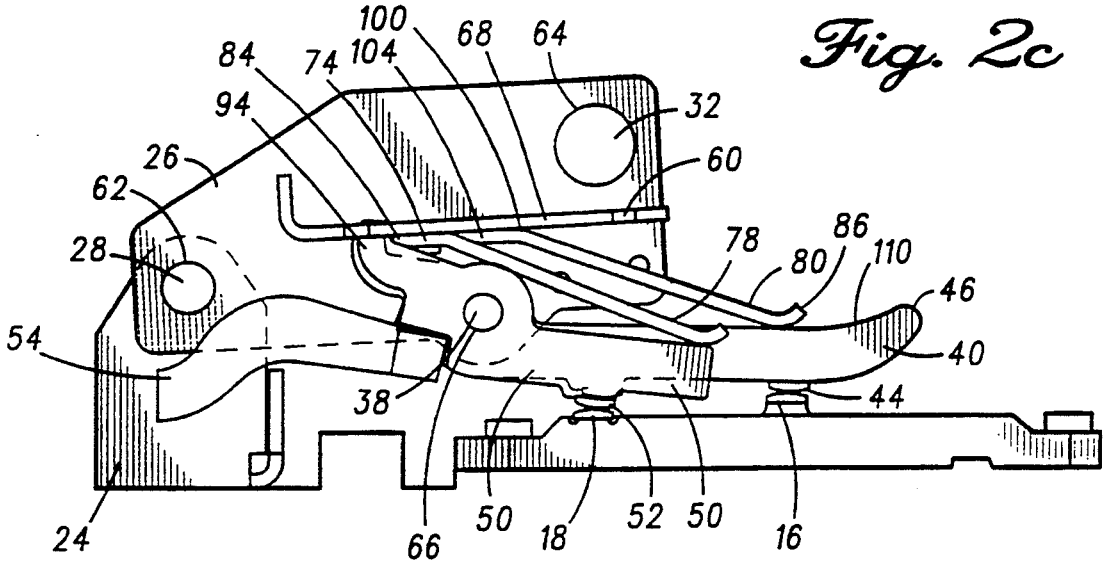

The FIG. 2C specifically illustrates the engaging of the movable main contacts 42 (not shown) with the stationary main contacts 18. The short cantilever 78 is exerting force against the contact blade 50 and subsequently forcing the main contacts together 52 and 18. At this step, both the arcing contacts 44, 16 and the main contacts 52, 18, and 42 are engaged.

Figure 2D:
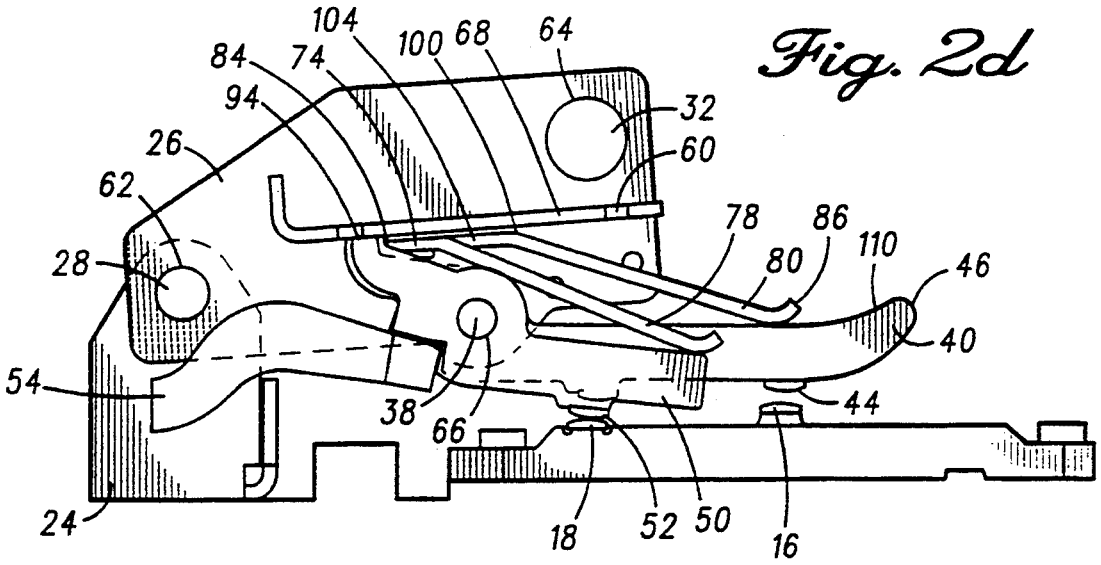

The breaker is fully latched in a closed position in FIG. 2D as the main contacts 18, 42 (not shown), and 52 remain closed. The downward movement of the carrier 26 pushes the pivot 32 downward as well. At this point the main contacts 18, 42 act as a fulcrum causing the distal end 46 of the contact blade to rise and separating the arcing contacts 16, 44. The force exerted by the long cantilever 80 is overcome by the downward pressure of the carrier 26, allowing the arcing contacts 44, 16 to separate. As a result, the force exerted on both the arcing contacts 44 and the main contacts 42 is fully transferred onto the main contacts 42 alone.

Figure 4:
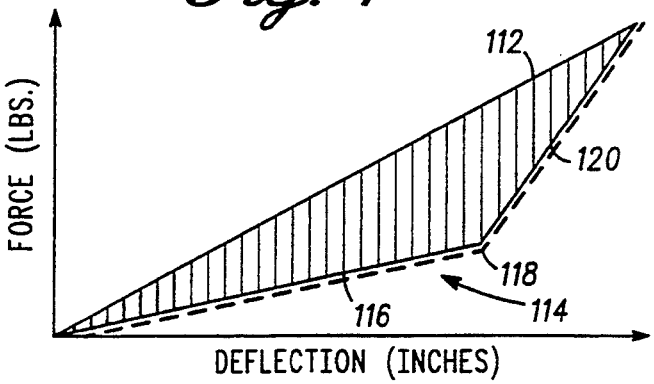
FIG. 4 is a graph illustrating the non-linear relationship of the force exerted by a spring of the present invention versus deflection between the spring plate and contact blade of a circuit breaker compared to a spring of the prior art.

Another illustration of the operation of the spring is shown in FIG. 4. The line marked 112 represents the generally linear relation exerted by springs in the prior art as force increases with deflection. The line marked 114 represents the non-linear relationship exerted by the inventive spring. The first segment 116 of the line to point 118 exerts less force than commonly exerted by prior art springs. The force exerted by the inventive spring 74 during this first segment 116 corresponds to the operation of the breaker moving from FIGS. 2A to 2B. Point 118 corresponds to the second angular bend 100 abutting the spring plate 68. From this position forward, the inventive spring exerts significantly more force per displacement than the prior art springs. The second segment 120 of the line corresponds to the operation of the breaker moving from FIGS. 2B to 2D. The shaded area represents the energy saved by operating the inventive spring compared to the prior art springs.

As the breaker is operated from an open to a closed position, a period of time passes from the contacts first touching until the breaker latches as illustrated in FIGS. 2B–2D. During this time period, the operating mechanism must provide energy to overcome the deflection of the spring on the contact blade. The energy drained from the spring slows the operation of the breaker.

The inventive spring overcomes this problem by exerting a non-linear force versus deflection relationship. Energy is saved by the exerted force and spring rate remaining low until after the arcing contacts touch. The inventive spring also avoids complications caused by the operating mechanism not efficiently transmitting force to overcome deflection of the spring on the contact blade.

As illustrated, the one-piece inventive spring provides individual support to multiple contact blades. Assembly of the circuit breaker is made easier and inventory costs are lowered with fewer parts needed.

Another of the many unique features of the present invention is to pre-determine at what point in the operating cycle of the breaker closing that the increase in force is desired.

The present invention is not limited to the use of angular bends to effectively shorten the length of the spring. For example, the arch of the spring can be a continuous curve having a changing radii at the appropriate points in the length.

Preferably the spring is made of an elastic material. For repeated use, the spring should be capable of recovering its shape after deformation. Tempered or galvanized steel are examples of suitable materials for use with the invention.

The present invention is specifically disclosed for use with one, two, and three pole circuit breakers sold by the Square D Company under the catalog designation low-voltage switchgear. The switchgear is capable of utilizing about 800 through about 4000 Amp frame sizes.

As those skilled in the art will appreciate, the inventive spring can be adapted and configured for use with a wide variety of circuit breakers and other circuit interrupters. The inventive spring is suitable for use in low, medium, and high voltage applications. The term circuit interrupter is defined to include but not be limited to, single or polyphase circuit breakers, vacuum or air circuit breakers, fusible switches, switchgear and the like.

While particular embodiments and applications of the present invention have been illustrated and described, it is to be understood that the invention is not limited to the precise construction and compositions disclosed herein and that various modifications, changes, and variations which will be apparent to those skilled in the art may be made in the arrangement, operation, and details of construction of the invention disclosed herein without departing from the spirit and scope of the invention as defined in the appended claims.

What is claimed is:

1. A spring exerting a non-linear force between a contact carrier and a contact blade in a circuit interrupter, the spring comprising:

at least one elongated cantilever portion, the length of the cantilever portion having the shape of an arch made with a non-uniform angle across the length of the cantilever portion, the cantilever portion being formed from an elastic material;

means for supporting one end of the cantilever portion against the carrier with the length of the cantilever portion positioned parallel to the carrier and the opposite end of the cantilever portion abutting the contact blade so that the carrier supports an increasing amount of the length of the cantilever portion as the displacement between the carrier and the contact blade decreases.

2. The spring of claim 1 wherein the arch includes at least one angular bend positioned between generally straight segments across the length of the cantilever portion.

3. The spring of claim 2 wherein each angular bend is positioned at a pre-determined point along the length of the cantilever portion to exert a greater force between the carrier and the contact blade than the other segments along the length of the cantilever portion when the carrier supports the angular bend.

4. The spring of claim 1 wherein the opposite end of the cantilever portion includes a curl extending in the direction opposite the angle of the arch so that a smooth surface is provided at the opposite end of the cantilever portion to slide along the surface of the contact blade as displacement between the carrier and the contact blade changes.

5. The spring of claim 1 wherein the spring further includes a plurality of elongated cantilever portions, each of the cantilever portions extending parallel to one another from the supporting means, the plurality of cantilever portions having different lengths associated therewith and abutting more than one contact blade and having different non-uniform angles for the shape of the arch.

6. The spring of claim 5 wherein the plurality of cantilever portions includes three cantilever sets:

a first and second cantilever set having cantilever portions a predetermined length for abutting the two contact blades, each arch of the first and second set of cantilever portions includes an angular bend positioned near the supporting means end with a generally straight segment across the length of the cantilever portions to the opposite end;

a third cantilever set disposed between the first and second cantilever sets and in the same plane, the third cantilever set having cantilever portions having a second predetermined length for abutting a third contact blade, each arch of the third set of cantilever portions includes a first angular bend positioned near the supporting means end and a second angular bend positioned about midway across the length of each cantilever portion with straight segments positioned between the two angular bends and both ends of each cantilever portion.

7. A circuit interrupter assembly comprising:

at least one stationary electrical contact located therein;

at least one movable contact operable between open and closed positions with respect to each stationary contact, each movable contact attached to a contact blade;

a contact carrier hingedly attached to the contact blade;

means for effecting movement of the carrier and the contact blade so that the movable contact moves between the open and closed positions, the moving means connected to the carrier; and a spring disposed between the carrier and the contact blade, the spring having at least one elongated cantilever portion, the length of the cantilever portion having the shape of an arch made with a non-uniform angle across the length of the cantilever portion, the cantilever portion being formed from an elastic material, the spring having means for supporting one end of the cantilever portion against the carrier with the length of the cantilever portion positioned parallel to the carrier and the opposite end of the cantilever portion abutting the contact blade so that the carrier supports an increasing amount of the length of the cantilever portion as the displacement between the carrier and the contact blade decreases.

8. The circuit interrupter of claim 7 wherein the arch includes at least one angular bend positioned between generally straight segments across the length of the cantilever portion.

9. The circuit interrupter of claim 8 wherein each angular bend is positioned at a pre-determined point along the length of the cantilever portion to exert a greater force between the carrier and the contact blade than the other segments along the length of the cantilever portion when the carrier supports the angular bend.

10. The circuit interrupter of claim 7 wherein the opposite end of the cantilever portion includes a curl extending in the direction opposite the angle of the arch so that a smooth surface is provided at the opposite end of the cantilever portion to slide along the surface of the contact blade as displacement between the carrier and the contact blade changes.

11. The circuit interrupter of claim 7 wherein the spring further includes a plurality of elongated cantilever portions, each of the cantilever portions extending parallel to one another from the supporting means, the plurality of cantilever portions having different lengths associated therewith and abutting more than one contact blade and having different non-uniform angles for the shape of the arch.

12. The circuit interrupter of claim 7 wherein the assembly includes:

an arcing stationary contact and a main stationary contact;

an arcing movable contact attached to a first contact blade and a main movable contact attached to a second contact blade;

the carrier hingedly attached to the first and second contact blade;

the spring having a first and second set of cantilever portions having a pre-determined length for abutting the two contact blades, each arch of the first and second set of cantilever portions includes an angular bend positioned near the supporting means end with a generally straight segment across the length of the cantilever portions to the opposite end;

a third cantilever set disposed between the first and second cantilever sets and in the same plane, the third cantilever set having cantilever portions having a second pre-determined length for abutting a third contact blade, each arch of the third set of cantilever portions includes a first angular bend positioned near the supporting means end and a second angular bend positioned about midway across the length of each cantilever portion with straight segments positioned between the two angular bends and both ends of each cantilever portion.

13. Circuit interrupter of claim 7 wherein the carrier includes a spring plate attached thereto in a position parallel and overlapping the contact blade, whereby the spring is coupled to the spring plate.

14. A method of operating a circuit interrupter having at least one stationary contact, at least one movable contact attached to a contact blade and moved into open and closed positions by a contact carrier, and a spring disposed between the contact carrier and the contact blade for exerting a force against the contact blade, the method comprising the steps of:

exerting a pre-determined force against the contact blade attached to the movable contact;

engaging the movable contact against the stationary contact; and increasing the force exerted against the contact blade.

15. The method of claim 14 wherein the method further includes the steps of:

providing at least one stationary arcing contact and a corresponding movable arcing contact;

engaging the movable arcing contact against the stationary arcing contact before the step of engaging the movable contact against the stationary contact;

increasing the force exerted against the contact blade during the step of engaging the movable arcing contact against the stationary arcing contact; and disengaging the movable arcing contact from the stationary arcing contact after the step of engaging the movable contact against the stationary contact and transferring the force exerted against the movable arcing contact to the movable contact.

16. The method of claim 15 wherein the disengaging and transferring step includes rocking the contact blade over a fulcrum comprised of the movable and stationary contacts engaged together so that the movable and stationary arcing contacts separate.

* * * * *